US006786514B2

(12) United States Patent
Gledhill

(10) Patent No.: US 6,786,514 B2
(45) Date of Patent: Sep. 7, 2004

(54) SELECTIVELY ADJUSTABLE LABEL

(76) Inventor: Dale C. Gledhill, 6 Eaglewood La., Sandy, UT (US) 84092

( * ) Notice: Subject to any disclaimer, the term of this patent is extended or adjusted under 35 U.S.C. 154(b) by 0 days.

(21) Appl. No.: 10/229,198

(22) Filed: Aug. 27, 2002

(65) Prior Publication Data

US 2004/0041391 A1 Mar. 4, 2004

(51) Int. Cl.[7] ..... B42D 15/00

(52) U.S. Cl. ..... 283/81; 206/459.1; 220/8; 283/101; 428/40.1; 446/379

(58) Field of Search ..... 283/81, 101, 106, 283/117; 220/8; 206/459.1, 425; 428/40.1, 42.1, 43; 446/379, 382, 383

(56) References Cited

U.S. PATENT DOCUMENTS 4,627,994 A * 12/1986 Welsch ..... 428/42.2
4,726,972 A * 2/1988 Instance ..... 428/41.8
4,890,862 A * 1/1990 Buchholz ..... 283/62
5,752,723 A * 5/1998 Robertson ..... 283/67
5,803,499 A * 9/1998 Tung et al. ..... 283/56
5,894,923 A * 4/1999 Hamstra et al. ..... 206/232
6,428,407 B1 * 8/2002 Elder ..... 451/530

* cited by examiner

*Primary Examiner*—Monica S. Carter
(74) *Attorney, Agent, or Firm*—Workman Nydegger

(57) ABSTRACT

A label is provided including a first end, a second end, and an intermediate portion, wherein the intermediate portion is selectively adjustable between a retracted position in which a portion of the intermediate portion is obscured, and an extended position in which at least a portion of the intermediate portion that was obscured is clearly seen or easily distinguished.

13 Claims, 5 Drawing Sheets

SELECTIVELY ADJUSTABLE LABEL

BACKGROUND OF THE INVENTION

1. The Field of the Invention

The present invention relates to labels used for marketing products. More specifically, the present invention relates to a selectively adjustable label.

2. The Relevant Technology

Almost every consumer good (usually required by law) has a corresponding label which provides relevant knowledge about the product to the consumer. In addition to informational purposes, unique or distinctive packaging of goods has proved beneficial in enticing consumers to buy a certain product. The present invention relates to labels used in marketing of products.

BRIEF DESCRIPTION OF THE DRAWINGS

Various embodiments of the present invention will now be discussed with reference to the appended drawings. It is appreciated that these drawings depict only typical embodiments of the invention and are therefore not to be considered limiting of its scope.

DETAILED DESCRIPTION OF THE PREFERRED EMBODIMENTS

The present invention provides labels which may be implemented in conjunction with various selectively adjustable devices. Throughout this description, it will be appreciated that the present invention is not limited to the particular devices described in the following description. Rather, the labels of the present invention may be readily employed in conjunction with a variety of devices in accordance with the teachings of the present invention.

Figure 1:
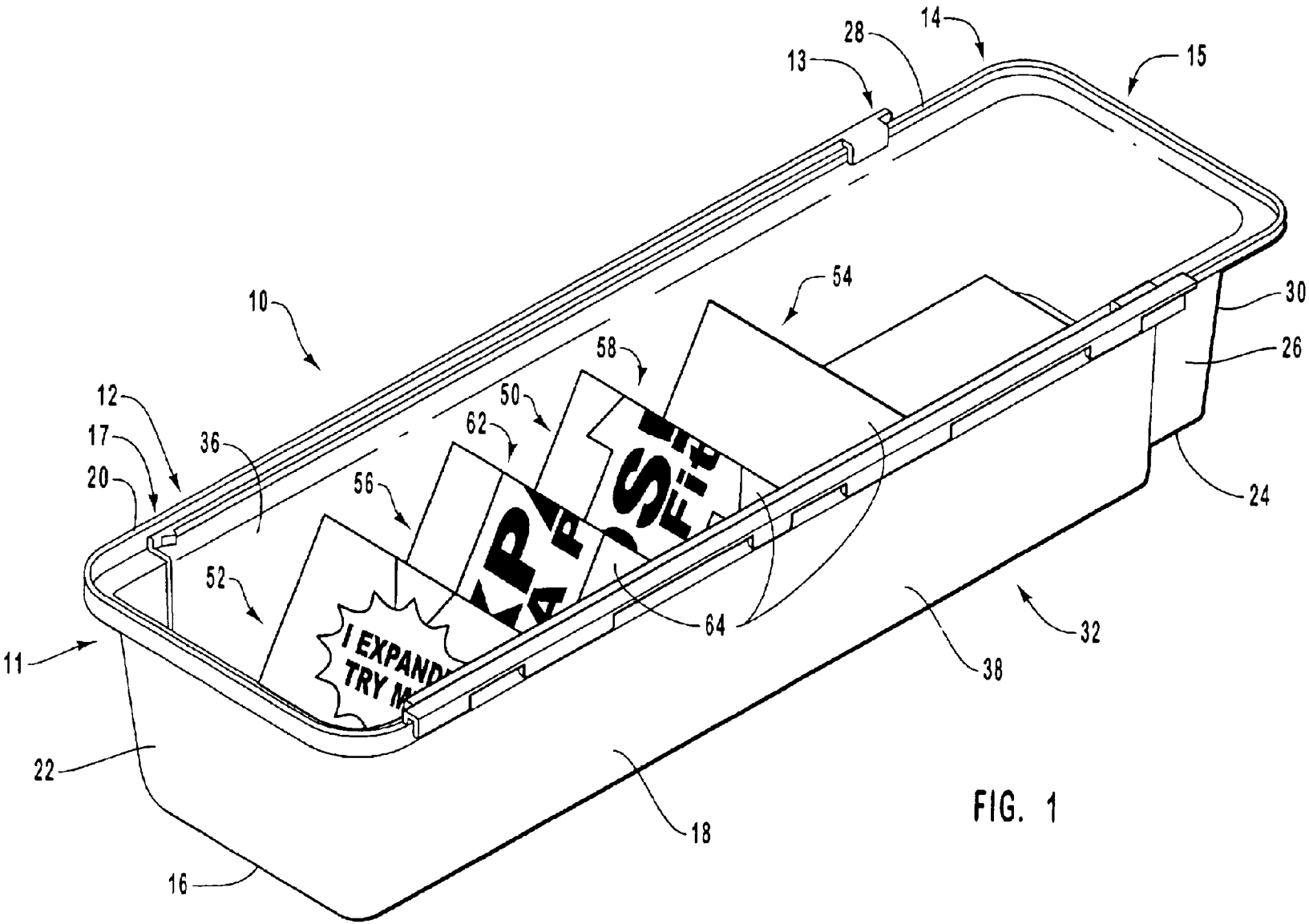
FIG. 1 illustrates a perspective view of a label of the present invention in a retracted position.

In one embodiment, shown in FIG. 1, a label of the present invention is used with a container that is selectively adjustable between a retracted position and an extended position. A container similar to that shown in FIG. 1 is discussed in greater detail in U.S. patent application Ser. No. 10/229,197 herein incorporated by reference. FIG. 1 depicts a container 10 comprising a first portion 12 having a first end 11 and a second end 13 and a second portion 14 having a first end 15 and a second end 17. First portion 12 includes a bottom surface 16, first and second sidewalls 18, 20, and an end wall 22. Likewise, second portion 14 includes a bottom surface 24, first and second sidewalls 26, 28, and an end wall 30. First portion 12 and second portion 14 have a substantially U-shaped cross-section. Container 10 also has an inside surface 36 and an outside surface 38. First portion 12 is slidably coupled with second portion 14. Thus, container 10 is selectively adjustable between a retracted position 32 and an extended position 34.

As used in the specification and claims, the term "retract" refers to the position of the device when it is being drawn inward. The term "extend" refers to the position of the device when it is being drawn outward. In one embodiment, the device has adjustable limits which limit the extent of retraction or extension. Where a device has adjustable limits, the device may be selectively adjusted between a fully retracted and a fully extended position. It will be appreciated that the device may be selectively adjusted an infinite number of distances between a fully retracted position and a fully extended position.

Figure 2:
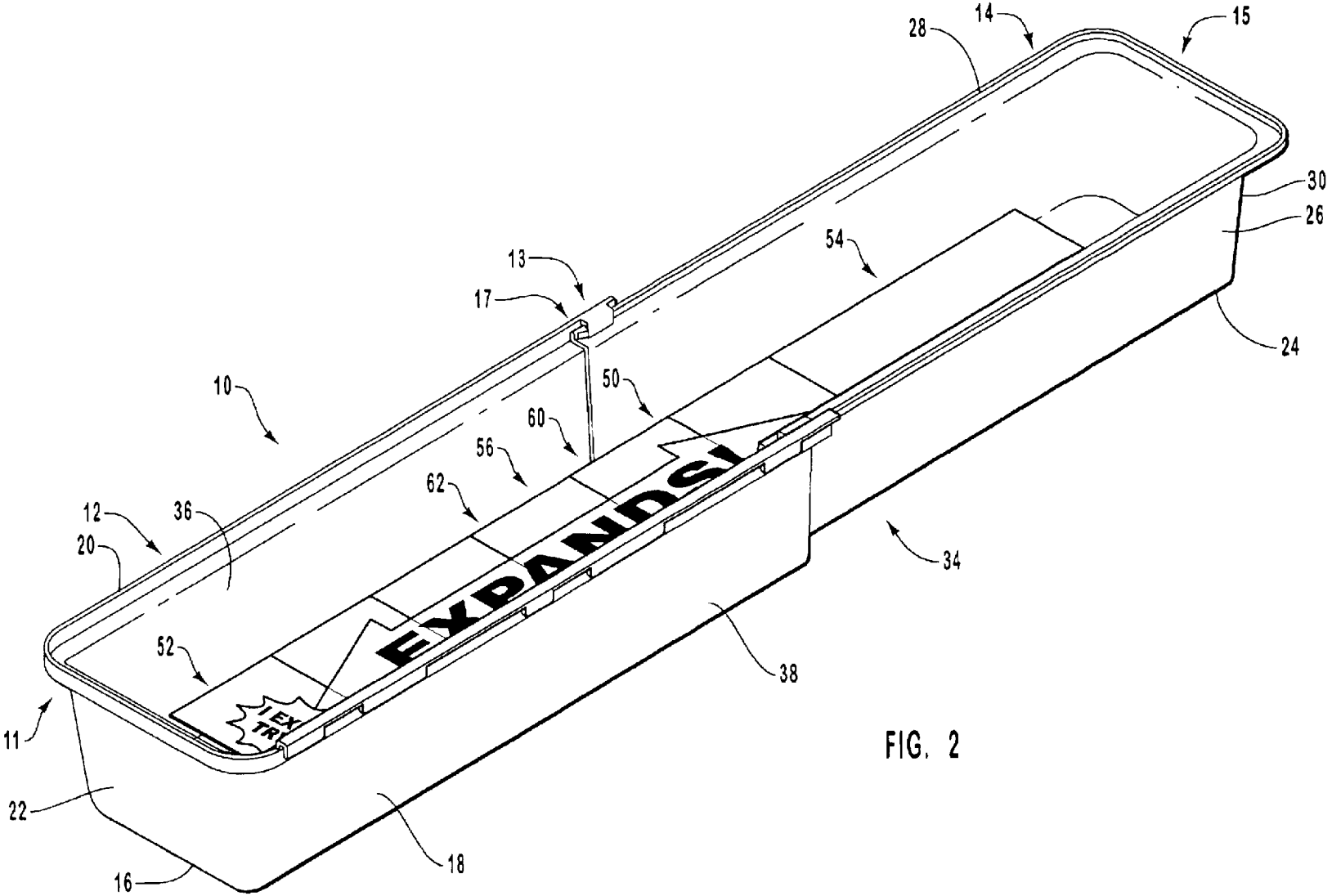
FIG. 2 illustrates a perspective view of the label of FIG. 1 in an extended position.
Figure 3A:
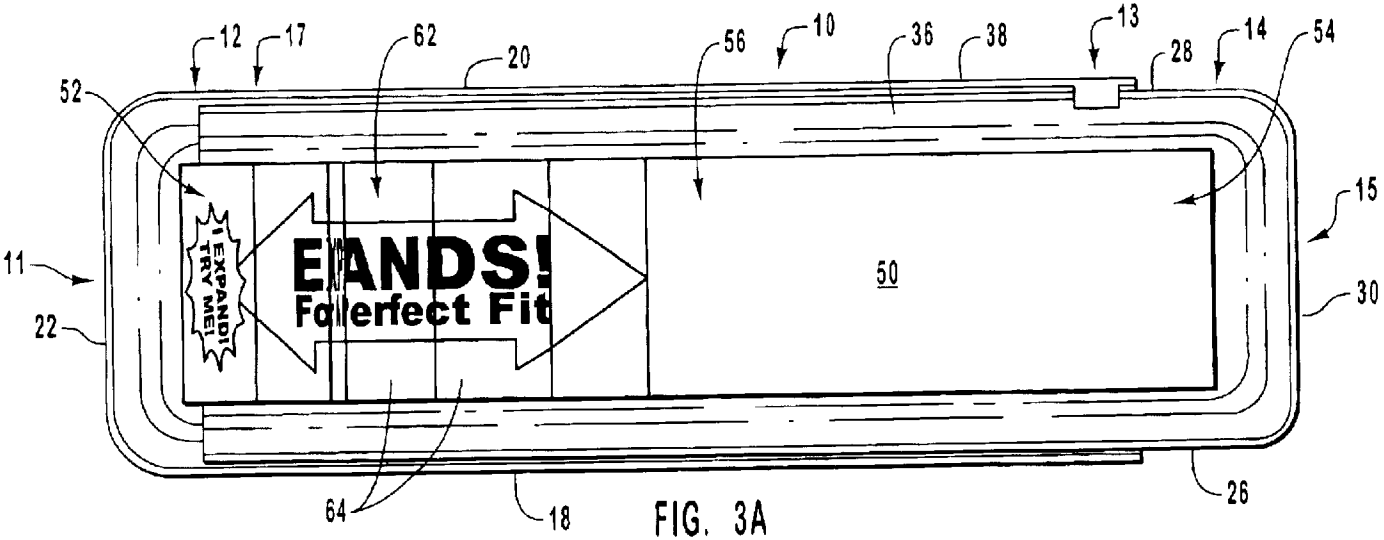
FIG. 3A illustrates a top view of the label of FIG. 1 in a retracted position.
Figure 3B:
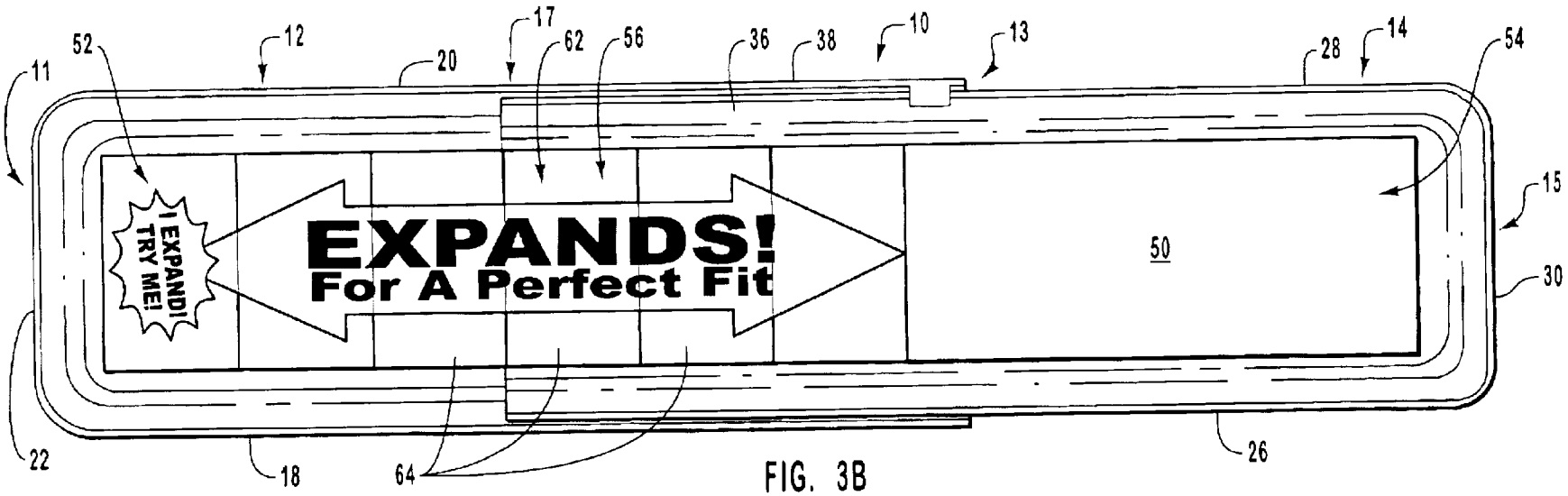
FIG. 3B illustrates a top view of the label of FIG. 1 in an extended position.
Figure 4A:
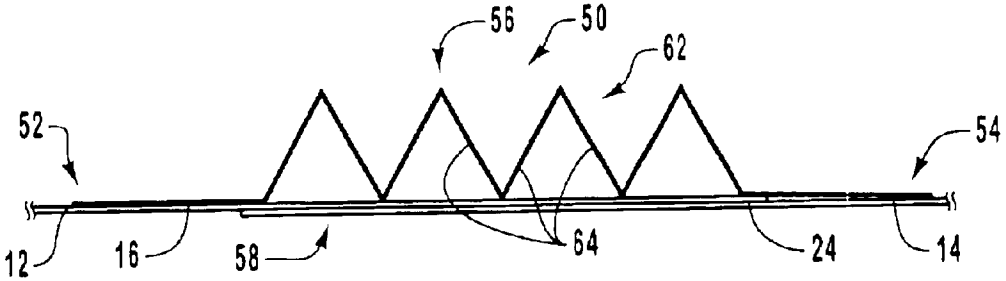
FIG. 4A illustrates a side view of the label of FIG. 1 in a retracted position.
Figure 4B:
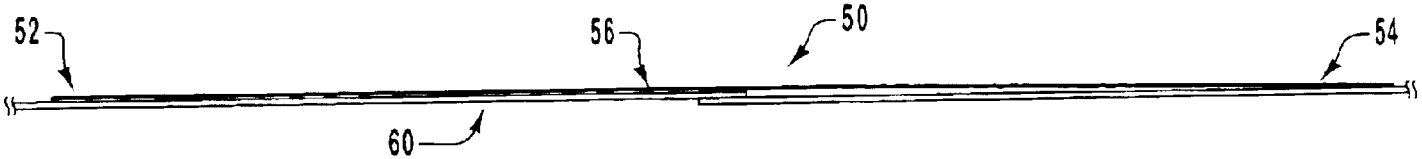
FIG. 4B illustrates a side view of the label of FIG. 1 in an extended position.

FIGS. 1 and 2 show a label 50 in accordance with the present invention disposed on bottom surfaces 16, 24 of container 10. Label 50 may have various indicia or wording printed, engraved, painted, or otherwise disposed thereon. In the embodiment shown in FIGS. 1 and 2, label 50 is disposed on inside surface 36 of container 10. Label 50 has a first end 52, a second end 54, and an intermediate portion 56. First end 52 and second end 54 of label 50 are connected to first portion 12 and second portion 14, respectively, of container 10. Label 50 may be connected to container 10 by any suitable means, such as, but not limited to, adhesive, staples, clips, and the like. Intermediate portion 56 is configured to be selectively adjustable between a retracted position 58 and an extended position 60.

As used in the specification and claims, the term "retract" refers to the position of the label when it is being drawn inward. The term "extend" refers to the position of the label when it is being drawn outward. In one embodiment, the label has adjustable limits which limit the extent of retraction or extension. Where a label has adjustable limits, the label may be selectively adjusted between a fully retracted and a fully extended position. It will be appreciated that the label may be selectively adjusted an infinite number of distances between a fully retracted position and a fully extended position.

In the embodiment shown in FIGS. 1–4B, intermediate portion 56 is configured to be selectively adjustable by having a folded portion 62. Folded portion 62 comprises folds 64 which, when label 50 is in a retracted position 58, are compressed such that a portion of intermediate portion 56 is obscured from view. As used in this specification and claims, the term "obscure" is used to refer to a portion of label 50 that is not clearly seen or easily distinguished. The term "obscure" also includes a portion of label 50 that is hidden so as to not be clearly seen or easily distinguished. When label 50 is in an extended position 60, folds 64 at least somewhat decompress so that at least a portion of the intermediate portion 56 that was obscured is now clearly seen or easily distinguished. It will be appreciated that folded portion 62 may comprise a single fold or multiple folds. Folded portion 62 is but one embodiment for obscuring a portion of intermediate portion 56.

In one embodiment, the fully extended position of label 50 corresponds to the fully extended position of container 10. In other words, when both label 50 and container 10 are in a fully extended position, the length of label 50 is substantially the same as the length of container 10. In another embodiment, the fully extended position of label 50 does not correspond to the fully extended length of container 10. In this embodiment, label 50 may in fact limit the extension of container 10.

In another embodiment, not depicted in the figures herein, the label of the present invention may be disposed on the outside surface of the device. For example, the label could be disposed on outside surface 38 of container 10. First end 52 and second end 54 of label 10 would be connected to the outside surfaces of first portion 12 and second portion 14, respectively, of container 10.

Figure 5A:
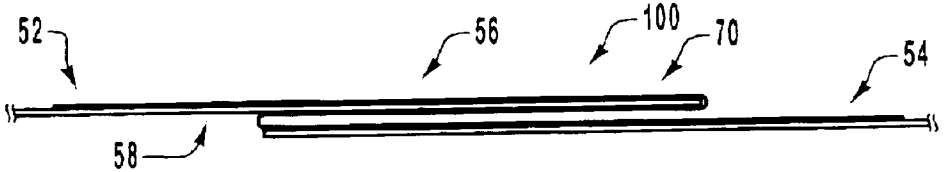
FIG. 5A illustrates a side view of another embodiment of the label of the present invention in a retracted position.
Figure 5B:
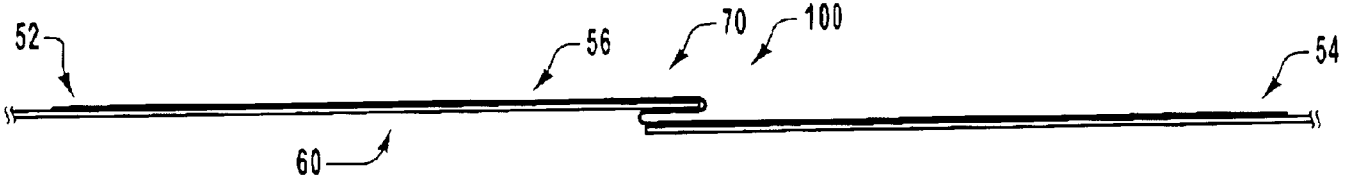
FIG. 5B illustrates a side view of the embodiment of FIG. 5A in an extended position.

Shown in FIGS. 5A and 5B, label 100 may comprise a single piece of material, which piece is selectively adjustable between a retracted position 58 and an extended position 60. In the embodiment of FIGS. 5A and 5B, intermediate portion 56 is configured to be selectively adjustable by having a substantially S-shaped curve 70. At least a portion of S-shaped curve 70 comprises a flexible material which wraps around bottom surface 16 of first portion 12 and doubles over between first portion 12 and second portion 14 of container 10. Depicted in FIG. 5A, when container 10 is in a retracted position 32, label 100 is also in a retracted position 58 wherein at least a portion of intermediate portion 56 remains obscured underneath first portion 12. Depicted in FIG. 5B, when container 10 is in an extended position 34, label 100 is in an extended position 60 wherein a portion of the intermediate portion 56 that was obscured is clearly seen or easily distinguished. In one embodiment, label 100 is attached to second end 17 of second portion 14 so that intermediate portion 56 can more easily fold underneath first portion 12 of container 10.

Figure 6A:
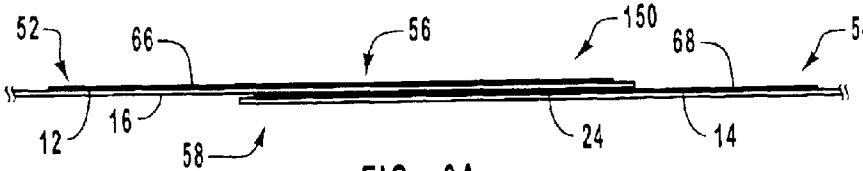
FIG. 6A illustrates a side view of yet another embodiment of the label of the present invention in a retracted position.
Figure 6B:
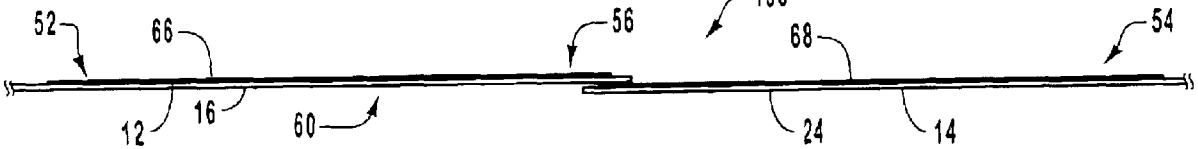
FIG. 6B illustrates a side view of the embodiment of FIG. 6A in an extended position.

FIGS. 6A and 6B show an embodiment of label 150 comprising two pieces configured to act as a single label. Intermediate portion 56 comprises a first portion 66 disposed on bottom surface 16 of first portion 12 of container 10. Intermediate portion 56 also comprises a second portion 68 disposed on bottom surface 24 of second portion 14 of container 10. In one embodiment, first portion 66 and second portion 68 lie substantially flat on bottom surfaces 16, 24 such that when container 10 is in a retracted position 32, a portion of second portion 68 of label 150 lies obscured underneath first portion 66. Thus, in a retracted position 58, at least a portion of intermediate portion 56 is obscured. In an extended position 60, at least a portion of intermediate portion 56 that was obscured is clearly seen or easily distinguished.

It will be appreciated that the device may comprise more than two portions. Accordingly, the label of the present invention may be attached to any two of the multiple portions.

In one embodiment, the label of the present invention is removably attached to the device so as to allow normal, everyday use of the device. Suitable materials for the label of the present invention may be paper, plastic (e.g., cellophane), an elastomeric material, thin metal, Mylar, and other materials suitable for packaging purposes.

Figure 7:
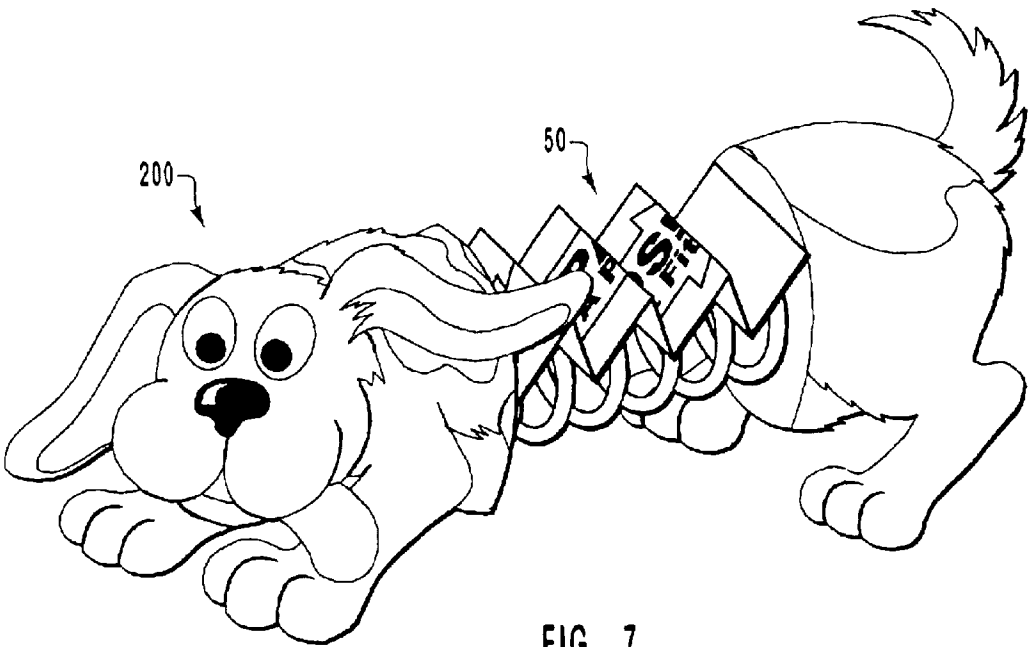
FIG. 7 illustrates a perspective view of the label of the present invention in connection with a selectively adjustable device.

It will be appreciated that the label of the present invention is not limited to the devices described in the present invention, but may be used in conjunction with a variety of devices. For example, as depicted in FIG. 7, label 50 is used in conjunction with a toy 200, the toy 200 being selectively adjustable between a retracted position and an extended position. Other devices which may be suitable for use with a label of the present invention include, but are not limited to, electronics, automobiles, housewares, appliances, and the like.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A label for use with a device, the device being selectively adjustable between a retracted position and an extended position, the label comprising:

a first end adapted to be connected to the device;

a second end adapted to be connected to the device; and an intermediate portion being selectively adjustable between a retracted position and an extended position, wherein in the retracted position a portion of the intermediate portion is obscured, and wherein in the extended position, at least a portion of the intermediate portion that was obscured is clearly seen or easily distinguished.

2. The label as recited in claim 1, wherein the intermediate portion comprises a folded portion.

3. The label as recited in claim 1, wherein the intermediate portion comprises a first portion and a second portion, the second portion being positioned beneath the first portion.

4. The label as recited in claim 1, wherein the intermediate portion comprises an S-shaped portion.

5. The label as recited in claim 1, wherein at least a portion of the intermediate portion is comprised of a flexible material.

6. An assembly for a label adapted to be used on a device, the assembly comprising:

a device comprising:

a first portion, and a second portion coupled to the first portion such that the first portion and the second portion are selectively adjustable between a retracted position and an extended position; and a label comprising:

a first end attached to the first portion of the device, a second end attached to the second portion of the device, and an intermediate portion being selectively adjustable between a retracted position, wherein a portion of the intermediate portion is obscured, and an extended position, wherein at least a portion of the intermediate portion that was obscured is clearly seen or easily distinguished.

7. The assembly as recited in claim 6, wherein the intermediate portion of the label comprises a folded portion.

8. The assembly as recited in claim 6, wherein the intermediate portion of the label comprises a first portion and a second portion, the second portion being positioned beneath the first portion.

9. The assembly as recited in claim 6, wherein the intermediate portion of the label comprises an S-shaped portion.

10. The assembly as recited in claim 6, wherein at least a portion of the intermediate portion of the label is comprised of a flexible material.

11. A label for use with a device, the device being selectively adjustable between a retracted position and an extended position, the label comprising:

a first end;

a second end, and an intermediate portion being selectively adjustable between a retracted position and an extended position, wherein in the retracted position a portion of the intermediate portion is obscured, and wherein in the extended position, at least a portion of the intermediate portion that was obscured is clearly seen or easily distinguished, wherein at least one of the first end and the second end is adapted to be connected to the selectively adjustable device.

12. The assembly as recited in claim 11, wherein the intermediate portion of the label comprises a folded portion.

13. The assembly as recited in claim 11, wherein at least a portion of the intermediate portion of the label is comprised of a flexible material.

* * * * *

UNITED STATES PATENT AND TRADEMARK OFFICE

CERTIFICATE OF CORRECTION

PATENT NO. : 6,786,514 B2
DATED : September 7, 2004
INVENTOR(S) : Peter Ciarrocchi, Jr.

It is certified that error appears in the above-identified patent and that said Letters Patent is hereby corrected as shown below:

Column 7,
Line 59, after the word "base", delete ":" and insert therefor -- ; --.

Signed and Sealed this

Twenty-sixth Day of April, 2005

JON W. DUDAS
*Director of the United States Patent and Trademark Office*

UNITED STATES PATENT AND TRADEMARK OFFICE

CERTIFICATE OF CORRECTION

PATENT NO. : 6,786,514 B2
DATED : September 7, 2004
INVENTOR(S) : Dale C. Gledhill It is certified that error appears in the above-identified patent and that said Letters Patent is hereby corrected as shown below:

This certificate supersedes Certificate of Correction issued April 26, 2005, the number was erroneously mentioned and should be vacated since no Certificate of Correction was granted.

Signed and Sealed this

Twenty-eighth Day of June, 2005

JON W. DUDAS
*Director of the United States Patent and Trademark Office*